US010351407B1

(12) United States Patent
Blichmann

(10) Patent No.: US 10,351,407 B1
(45) Date of Patent: Jul. 16, 2019

(54) ENHANCED BOTTLE FILLER ASSEMBLY

(71) Applicant: John Blichmann, Lafayette, IN (US)

(72) Inventor: John Blichmann, Lafayette, IN (US)

( * ) Notice: Subject to any disclaimer, the term of this patent is extended or adjusted under 35 U.S.C. 154(b) by 220 days.

(21) Appl. No.: 15/353,091

(22) Filed: Nov. 16, 2016

Related U.S. Application Data

(60) Provisional application No. 62/255,726, filed on Nov. 16, 2015.

(51) Int. Cl.
*B67C 3/10* (2006.01)
*B67C 3/28* (2006.01)

(52) U.S. Cl.
CPC . *B67C 3/10* (2013.01); *B67C 3/28* (2013.01)

(58) Field of Classification Search
CPC ..... B67C 3/10; B67C 3/28
USPC ..... 141/374
See application file for complete search history.

(56) References Cited

U.S. PATENT DOCUMENTS 3,181,576 A * 5/1965 Pellerino ..... B67C 3/20 141/198
3,450,175 A 6/1969 Norwood
3,757,835 A 9/1973 Copping
3,835,860 A * 9/1974 Garretson ..... A61B 17/1611 30/241
4,151,867 A * 5/1979 Wilhere ..... B67C 3/2637 141/291
4,180,272 A * 12/1979 Heitz ..... B65B 39/001 141/287
4,747,834 A * 5/1988 Prindle ..... A61D 7/00 141/2
4,749,010 A * 6/1988 Petell ..... B67C 3/2608 141/115
5,141,132 A * 8/1992 Whelan ..... B05B 9/0805 141/26
5,150,740 A 9/1992 Yun
5,186,224 A * 2/1993 Schirmacher ..... B67D 7/0294 137/588
5,651,398 A * 7/1997 Decker ..... B67D 7/344 137/892
5,822,874 A * 10/1998 Nemes ..... B44D 3/38 33/414
7,059,369 B2 * 6/2006 Krywitsky ..... B65G 53/52 141/258
7,730,912 B2 6/2010 Blichmann
8,033,043 B2 * 10/2011 McGarry ..... F41A 11/00 42/70.01

(Continued)

FOREIGN PATENT DOCUMENTS

DE 4224312 A1 * 1/1994 ..... B67C 9/00

*Primary Examiner* — Timothy L Maust
(74) *Attorney, Agent, or Firm* — Tyler B. Droste; Gutwein Law

(57) ABSTRACT

An enhanced bottle filler assembly for filling bottles with a liquid from a pressurized vessel into an unpressurized vessel. In a preferred embodiment a molded body has a fitting housing and a grip formed perpendicular to one another. A grip passage interposing the grip, a valve actuator interposing the grip passage, a housing passage interposing the fitting housing, wherein said housing passage is fluidly connected to the grip passage. Two tubes are placed inside each other forming an annulus where a compressed gas can be forced to the bottom of a vessel to purge the vessel of oxygen. A sealing mechanism allows a liquid to flow into the bottle when trigger is pulled.

18 Claims, 8 Drawing Sheets

(56) References Cited

U.S. PATENT DOCUMENTS

| | | | | |
|---|---|---|---|---|
| 8,146,625 | B2 * | 4/2012 | Xin | G01F 23/74<br>141/372 |
| 9,987,163 | B2 * | 6/2018 | Schaller | A61M 5/31526 |
| 2004/0129735 | A1 * | 7/2004 | Grach | F16N 11/10<br>222/389 |

* cited by examiner

ENHANCED BOTTLE FILLER ASSEMBLY

CROSS-REFERENCE TO RELATED APPLICATION

This U.S. Patent Application claims priority to U.S. Provisional Application 62/255,726 filed Nov. 16, 2015, the disclosure of which is considered part of the disclosure of this application and is hereby incorporated by reference in its entirety.

FIELD OF THE INVENTION

This invention relates generally to bottle filling devices, specifically to bottle filling devices for homemade beer and other liquid carbonated beverages.

BACKGROUND

It is known in the homemade beer (homebrew) market to utilize a specialized filler to transfer carbonated beer from a pressurized keg into a bottle for portability, gifts, entering into competitions, and the like. The alternative to filling from a keg is natural carbonation in the bottle; but this approach leaves undesirable yeast sediment in the bottom of each bottle. Simply pouring the beer into a bottle from a tap is possible, but too much carbonation is lost from foaming, leaving the beer flat. In addition, the presence of oxygen ($O_2$) in the bottle during transfer causes staling of the beer, adversely affecting the flavor and shelf life. The common solution to this is a device called a counter-pressure bottle filler (CPBF), which is common in both the commercial bottling and homebrew industry.

A typical homebrew CPBF is a simplified manual version of the commercial equivalents intended for rapid sequential bottle filling. U.S. Pat. No. 5,150,740 (Yun), U.S. Pat. No. 3,757,835 (Copping), and U.S. Pat. No. 3,450,175 (Norwood) show several commercial high speed fillers. Numerous suppliers manufacture and sell these traditional CPBF fillers. Also, many homebrewers make their own fillers using commercially available materials. The typical process to fill a bottle utilizing a homebrew type CPBF requires a very cumbersome process of turning several valves in a prescribed sequence in order to purge the bottle of air, pressurize the bottle to the same pressure as the keg to reduce foaming and carbonation loss, turn on the beer flow valve, gradually open the $CO_2$ relief valve to allow beer to flow, turn the beer valve off at the correct fill level, relieve the $CO_2$ pressure in the bottle, remove the filler assembly, and lastly cap the bottle. If any operations are missed, performed incorrectly, or done in the incorrect order, the bottle could be too foamy (lost carbonation), not at the correct fill level, inadequately purged of air, or overfilled. The pressurization of the bottle is necessary to prevent foam creation (loss of carbonation) from a sudden pressure change, whereby the dissolved $CO_2$ comes out of solution and creates foaming. This sudden pressure loss is due to the sharp turns from numerous fittings and elbows, in addition to the throttling nature of valves that would otherwise cause excessive foaming if the bottle were not pressurized prior to filling.

More recently, U.S. Pat. No. 7,730,912 (Blichmann), herein incorporated by reference, has shown improvement over previous bottle fillers. Additionally, current bottle fillers need tools to disassemble for cleaning and maintenance of the bottle filler. The grip of current bottle fillers utilizing metallic components have a tendency of getting cold from continuously filling multiple bottles. For some bottle fillers, the bottle filler comprises a trigger that rotates around a shaft, resulting in some challenge in griping the bottle filler securely to fill bottles. Furthermore, some bottle fillers include a rubber sealing member located at the distal or filling end that can also detach from the bottle filler altogether, resulting in a piece of rubber in the bottle that could pose a drinking hazard. Also, many other bottle fillers may develop a $CO_2$ leak from the valve actuator of the $CO_2$ valve, which is near the hand used to pull the trigger. This may result in condensation, unnecessary wasting of $CO_2$, and inferior usability when operating the bottle filler itself.

Accordingly it is an object of this invention to overcome these obstacles through improved functionality and design. The enhanced bottle filler assembly has improved on these various drawbacks to ensure easier, safer, and more reliable use in the filling of bottles and other containers.

BRIEF SUMMARY OF THE INVENTION

In one aspect, this disclosure relates to an enhanced bottle filler assembly (EBFA) comprising a molded body having a grip portion and a housing portion, wherein a grip passage interposes the grip portion and a housing passage interposes the housing portion. A valve passage between the grip passage and the housing passage, wherein said valve passage has valve actuator interposing configured to control the flow of gas through the grip passage. A fitting having a fitting passage can be integrated into the housing passage and configured to allow the fitting passage to be fluidly connected to the grip passage. An outer tube having an upper end and a lower end can be integrated into the fitting passage. An inner tube having an upper end and a lower end can be configured to fit inside the outer tube, forming an annulus between the inner and outer tube. A sealing mechanism can be coupled to the lower end of said outer tube and can extend past the lower end of the outer tube and the lower end of the inner tube. The sealing mechanism can further be configured to form a sealing relationship between the sealing mechanism and lower end of said inner tube. A trigger mechanism can be coupled to the upper end of the inner tube and configured to be capable of unseating the sealing mechanism from the lower end of the inner tube. Additionally, a double trigger mechanism can be coupled to the molded body and configured to depress said valve actuator to place the valve passage in an open position allowing a gas to pass through the valve passage and into the fitting passage and annulus In another aspect, this disclosure relates to an EBFA comprising a molded body surrounding a valve body and elbow. The molded body can provide a user with better control and operation of the EBFA by reducing heat transfer from the cold metal. The molded body surrounding a valve body and an elbow can have a grip portion surrounding primarily the valve body and a housing portion primarily surrounding the elbow. A passage can interpose between the valve body and the elbow. A valve actuator can interpose the valve body passage to allow the flow of gas through the valve body. An elbow having an elbow passage can be integrated into the housing portion of the molded body and configured to allow the elbow passage to be fluidly connected to the valve. An outer tube having an upper end and a lower end can be integrated into the elbow passage. An inner tube having an upper end and a lower end can be configured to fit inside the outer tube, forming an annulus between the inner and outer tube. A sealing mechanism can be coupled to the lower end of said outer tube and can extend past the lower end of the outer tube and the lower end of the inner tube. The sealing mechanism can further be configured to form a sealing relationship between the sealing mechanism and lower end of said inner tube. The sealing mechanism can also help to retain the inner tube. When assembled the outer tube is prevented from coming apart from the assembly due to the inherent design of the assembly. A trigger mechanism can be coupled to the upper end of the inner tube and configured to be capable of unseating the sealing mechanism from the lower end of the inner tube.

BRIEF DESCRIPTION OF THE DRAWINGS

The features and advantages of this disclosure, and the manner of attaining them, will be more apparent and better understood by reference to the following descriptions of the disclosed system and process, taken in conjunction with the accompanying drawings, wherein.

DETAILED DESCRIPTION OF THE INVENTION

Figure 1:
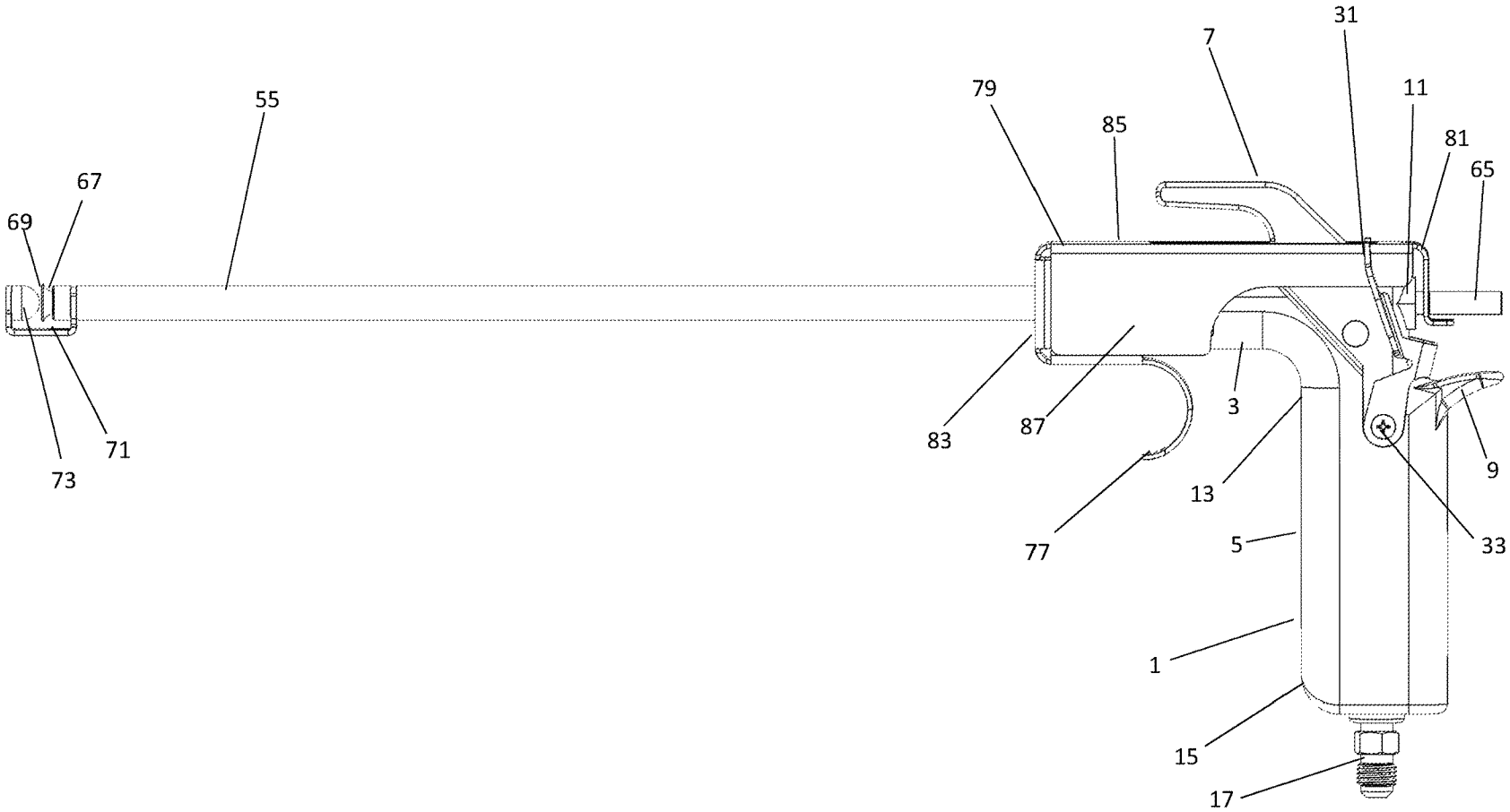
FIG. 1 is a cross-sectional view of an exemplary embodiment of the present invention.
Figure 2A:
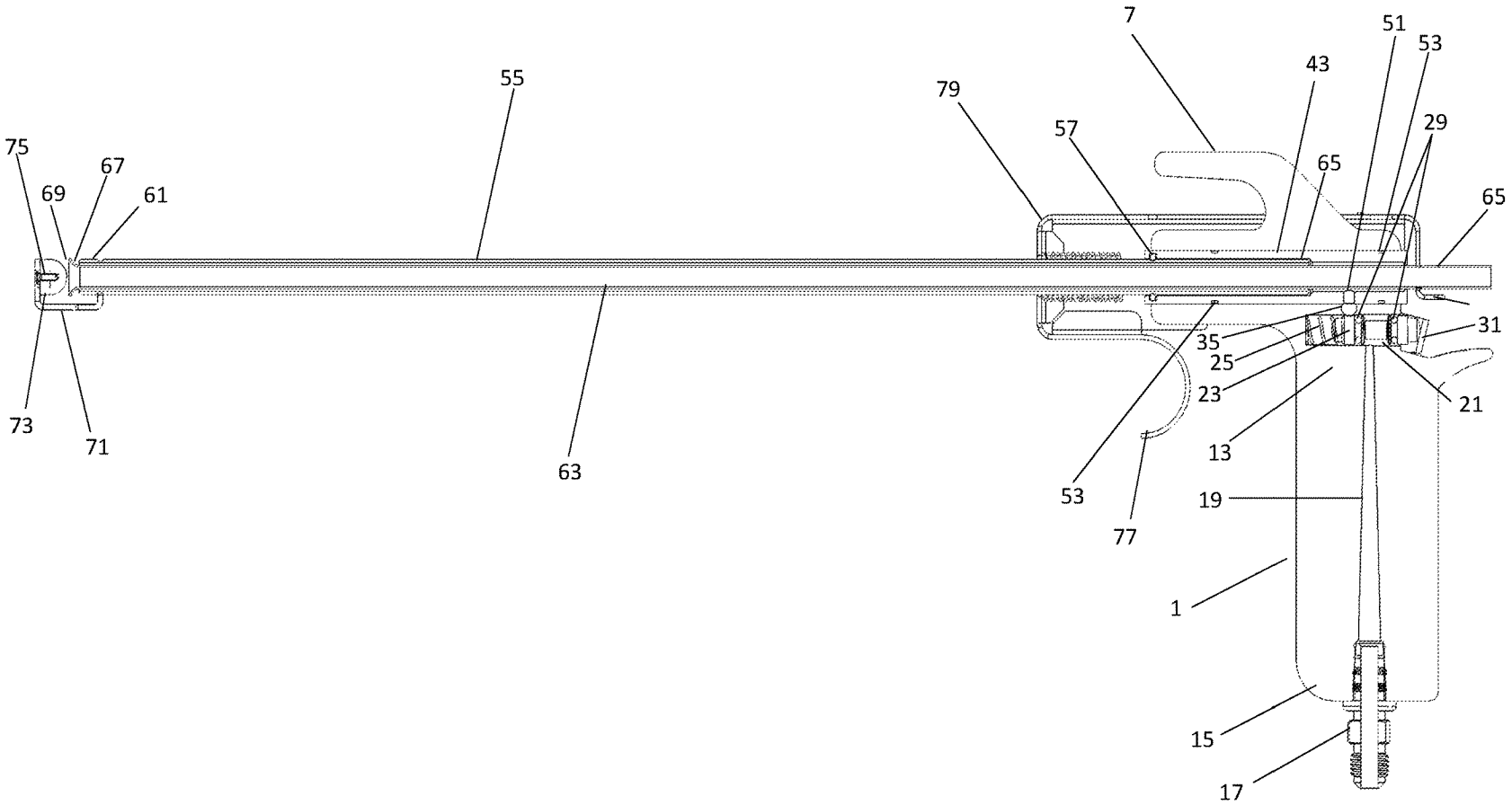
FIG. 2*a* is a side view of an exemplary embodiment of the present invention.
Figure 2B:
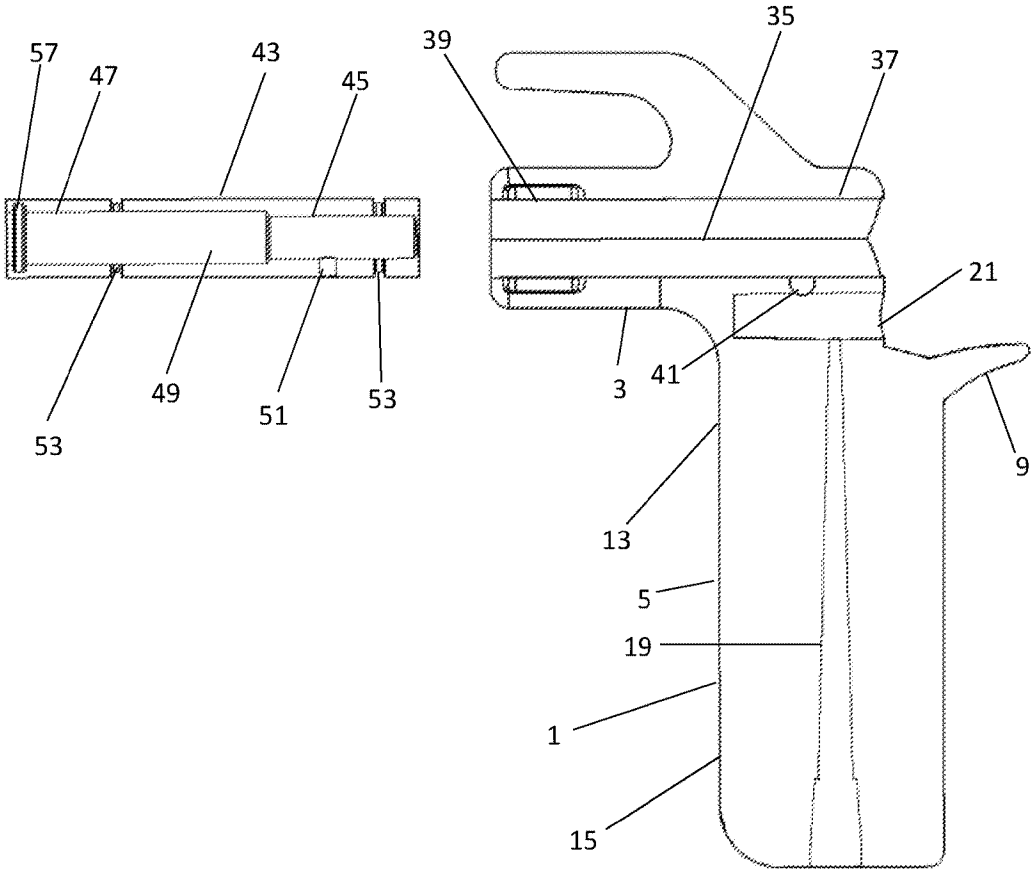
FIG. 2*b* is a cross-sectional view of an exemplary embodiment of the molded body and the fitting.

Referring initially to FIGS. 1 and 2, the EBFA includes a molded body 1 having a housing portion 3 and a grip portion 5. The molded body 1 can be made from a non-corrosive or anti-corrosive material, such as brass, stainless steel, polymer or other material. In one preferred embodiment, the molded body 1 is formed using injection molding, but any other suitable means, such as casting, can be used to form the molded body. The molded body 1 also ensures that the user does not experience extreme temperature variations that may occur during bottle filling activity. Additionally, the grip portion 5 can be formed in a manner that provides a texture or ridges that facilitate a firm grip and reduced slippage that may occur during operation of the EBFA.

The grip portion 5 can be formed relatively perpendicular to the housing portion 3. The relative angle between the grip portion 5 and the housing portion 3 can be any suitable angle to provide proper ergonomics. The molded body 1 can also have a protrusion 7 extending perpendicular from the housing that can be in the shape of a hook to facilitate hanging the EBFA on any suitable object, for example a stand, keg, or sink. The protrusion 7 may be used by the user intermittently during operation so that the EBFA does not have to be placed directly on the ground or shelf in between bottle fillings. This can reduce the risk of the EBFA from falling on the ground or being stepped on when not in operation and reduces the risk of becoming dirty or contaminated. In one exemplary embodiment, the grip portion 5 can further include a hand guard 9, such as a "beaver" tail design, on its dorsal side to facilitate proper hand placement and provide protection from any gas escaping near the upper end of the fitting 11, among other advantages.

The grip portion 5 further has an upper end 13 and a lower end 15, where the lower 13 end can be configured to accept a coupler fitting 17. The coupler fitting 17 can be press fit or threaded and can be used for attaching a regular or quick disconnect coupler, suitable for attaching the EBFA to an external compressed gas source, such as carbon dioxide or nitrogen gas. A grip passage 19 can extend between the lower end 15 of the grip 5 and the upper end 13 of the grip 5. The grip passage 19 is in fluid connection with a coupler 17 on the lower end 15 of the grip 5. The grip passage 19 may be interrupted by a valve passage 21 having a valve actuator 23 that can either be placed in an open position or closed position to allow or restrict the flow of a compressed gas through the valve passage 21.

A biasing means 25 for actuating the valve actuator 23 may be located within the molded body. The valve actuator 23 in its normal state has the passage between the two ends of the valve passage 21 in a closed position. The biasing means 25 can be comprised of a spring allowing a user to depress the valve actuator 23 that then places the valve 21 in the open position. The valve actuator 23 may further include o-rings 29 that form a seal to prevent the flow of gas through the passage when the valve actuator 23 is in the closed position. The o-rings 29 can be made from a variety of suitable materials, such as any suitable polymer.

The valve actuator 23 can be maintained inside the molded body 1 and can be depressed using an ambidextrous or double sided trigger mechanism 31 that can be coupled to a molded body 1. The double trigger 31 allows the EBFA to be used ambidextrously between the right and left hand. The double trigger 31 can be affixed to a molded body using any suitable fastener 33, such as a screw.

A housing passage 35 can extend from an upper end 37 and the lower end 39 of a housing portion 3. A housing passage 35 can be fluidly connected to grip passage 19 through a small aperture 41 connecting the upper end 37 of the housing passage 35 to the upper end 13 of the grip passage 5. The housing passage 35 can be configured to accept a fitting 43, which can extend the entire length of the upper and lower end of the housing. The fitting can protrude slightly from each end of the housing. The fitting can have an upper end 45 and a lower end 47 with a fitting passage 49 therethrough. The fitting 43 can have a small aperture 51 near the fitting's upper end that can allow the fitting passage 49 to be in fluid connection with the grip passage 19 of the molded body 1. The fitting 43 can be comprised of the same or similar material as the molded body, such as stainless steel, brass, copper, polymer, or any other suitable material.

Additionally, the exterior of the fitting and the housing's passage can be hexagonal in shape to help prevent the fitting from rotating within the housing. Similarly, in another exemplary embodiment the exterior of the fitting and the housing's passage can be knurled surface. The fitting 43 can have at least one groove 53 around the exterior of the fitting for a fitting insert. The fitting insert can be made from any suitable material, such as stainless steel and is placed on the fitting prior to the injection molding process that forms the molded body around the fitting. The fitting insert can help to lock the fitting 43 into place within the molded body 1 and prevent the fitting 43 from moving axially therein. The upper end 45 of the fitting passage 43 can have a first pre-established diameter and the lower end of 47 the fitting passage 43 can have a second pre-established diameter.

An outer tube 55 can be located within the lower end 47 of the fitting passage 43. The outer tube can be coupled to the fitting passage 43. One method of coupling can be with using o-rings 57 to press fit the outer tube within the fitting passage 43. The outer tube 55 can have a pre-established interior diameter and exterior diameter. The outer tube 55 has an upper end 59 and a lower end 61, where the upper end 59 may have a flared portion that can help seat the outer tube inside a lower end 47 of the fitting passage 49. The lower end 59 of the outer tube 55 extends past the end of the fitting 43 for a predetermined length.

The exterior diameter of the outer tube 55 is slightly smaller than the first predetermined diameter of the lower end 47 of the fitting passage 49. O-rings can 57 be located near the end of the upper end 45 and lower end 47 of the fitting to create an air tight seal between the fitting and the outer tube and an inner tube 63 respectively. The outer tube 55 can be made from stainless steel, copper, brass, or other suitable material.

Located within the outer tube 55 is an inner tube 63 having a pre-determined interior diameter and an exterior diameter. The exterior diameter is slightly smaller than the interior diameter of the outer tube 55 and second position of the passage of the fitting. An annulus is formed between the outside of the inner tube and the inside of the outer tube. The inner tube can have an upper end 65 and a lower end 67. The lower end 67 can extend past the lower end 61 of the outer tube and the upper end 67 can extend past the upper end 61 of the outer tube 55 and the upper end of the fitting. The lower end 67 of the inner tube 63 can be flared 69 to allow it to seat properly with a sealing mechanism 71. An external container, such as a keg under pressure, can be fluidly connected to the upper end 65 of the inner tube 63.

The sealing mechanisms 71 can be attached to the lower end 61 of the outer tube 55 and may have a seal member 71 that can be made out of a suitable polymer, such as silicone or rubber. The sealing mechanism 71 can extend beyond the length of the inner tube 63. A seal member 73 can be affixed to the sealing mechanism 71 using a pin 75 to ensure that the sealing member 73 will not easily be removed or accidentally detach from the sealing mechanism 71 while the EBFA is being operated or stored. In one exemplary embodiment, the pin 75 has a certain length that prevents the rubber seal from coming completely separated from the seal member when the second trigger 77 is fully depressed. To help create an adequate liquid-tight seal between the seal member 73 and the lower end 67 of the inner tube 63, the seal member 73 can be semi-spherical in shape, which can aid in conforming to the flared end 69 of the inner tube 61.

Figure 4A:
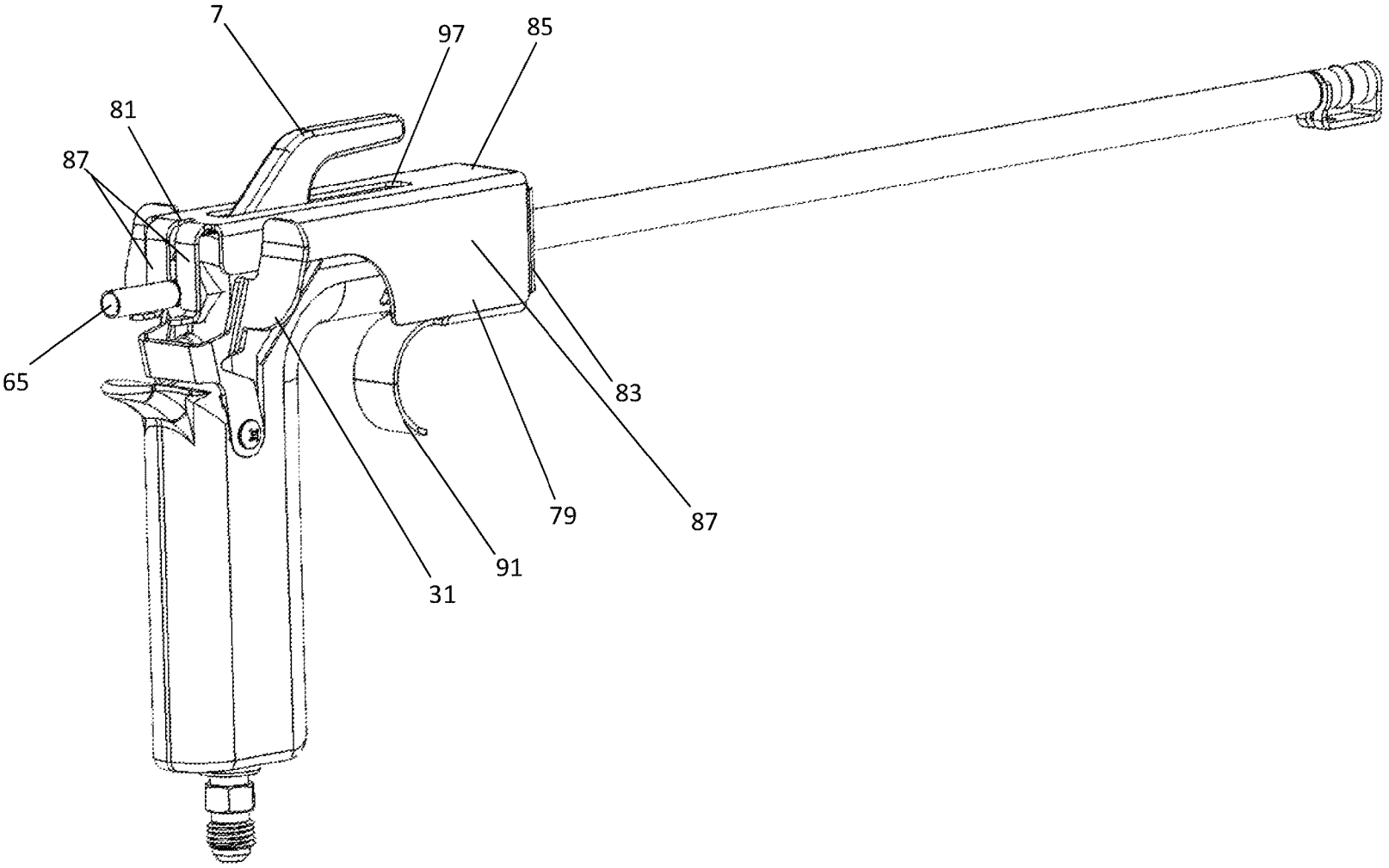
FIG. 4*a* is another three-quarters view of an exemplary embodiment of the present invention.
Figure 4B:
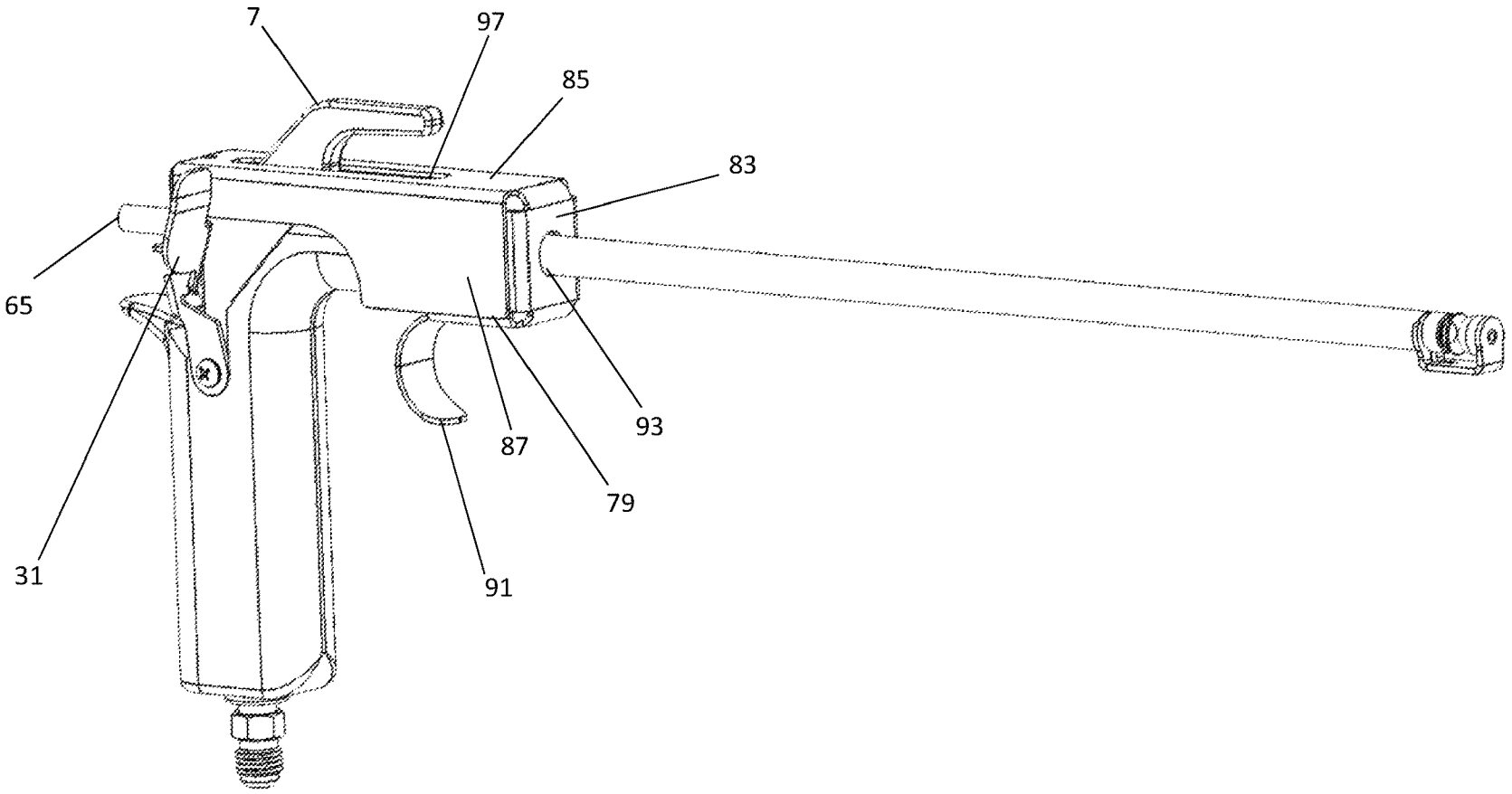
FIG. 4*b* is another three-quarters view of an exemplary embodiment of the present invention.

As shown further in FIG. 4*a-b*, an exemplary embodiment of the present invention can also include a trigger mechanism 79 that can have an upper end 81 and a lower end 83. The trigger mechanism 79 can be made from any suitable material, such as stainless steel, brass, or a polymer. The trigger mechanism 79 can have a 'U' shaped configuration and can include a base member 85, an upper end side member 87, and a lower end member 83. The base member 85 can be rectangular in shape having a length and width. It is understood that any suitable shape can be used that provides enough structural rigidity and strength to help prevent bending of the trigger mechanism while still being ergonomic in form and function.

The trigger mechanism's lower end member 83 can extend from the base member 85 at a 90 degree angle. The lower end member 83 can include a trigger portion 91. The trigger portion can have a trigger cover made of an anti-slip material, an insulated material, or a combination of both made of any suitable material, for example a polymer. The lower end member 83 can also have a bore 93 larger than the exterior diameter of the outer tube allowing the outer tube to be positioned within the bore. The upper end member 87 can extend from the base member 85 at a 90 degree angle.

The upper end member 81 can be connected to the inner tube's upper end 65. The upper end member 81 can have a slot forming two side members 87. The inner tube's upper end can have a groove 95 (shown in FIG. 3) that allows the inner tube 65 to be connected to the upper end member 81 of the trigger mechanism 79 by aligning the two side members 87 with the groove on the inner tube 65. This alignment allows the upper end member 81 to be mechanically connected to the inner tube 65.

The trigger mechanism 79 can also have a channel 97 running down the middle of the base member 85 between the upper 81 and lower end 85 to allow the protrusion 7 to protrude through the trigger mechanism 79 via the channel 97. This can provide additional stability to the EBFA while also preventing the trigger mechanism 79 from rotating around the molded body and outer tube. This ensures that the user will not have to continue to readjust the trigger mechanism while in use and provides easier use of the EBFA.

Figure 3:
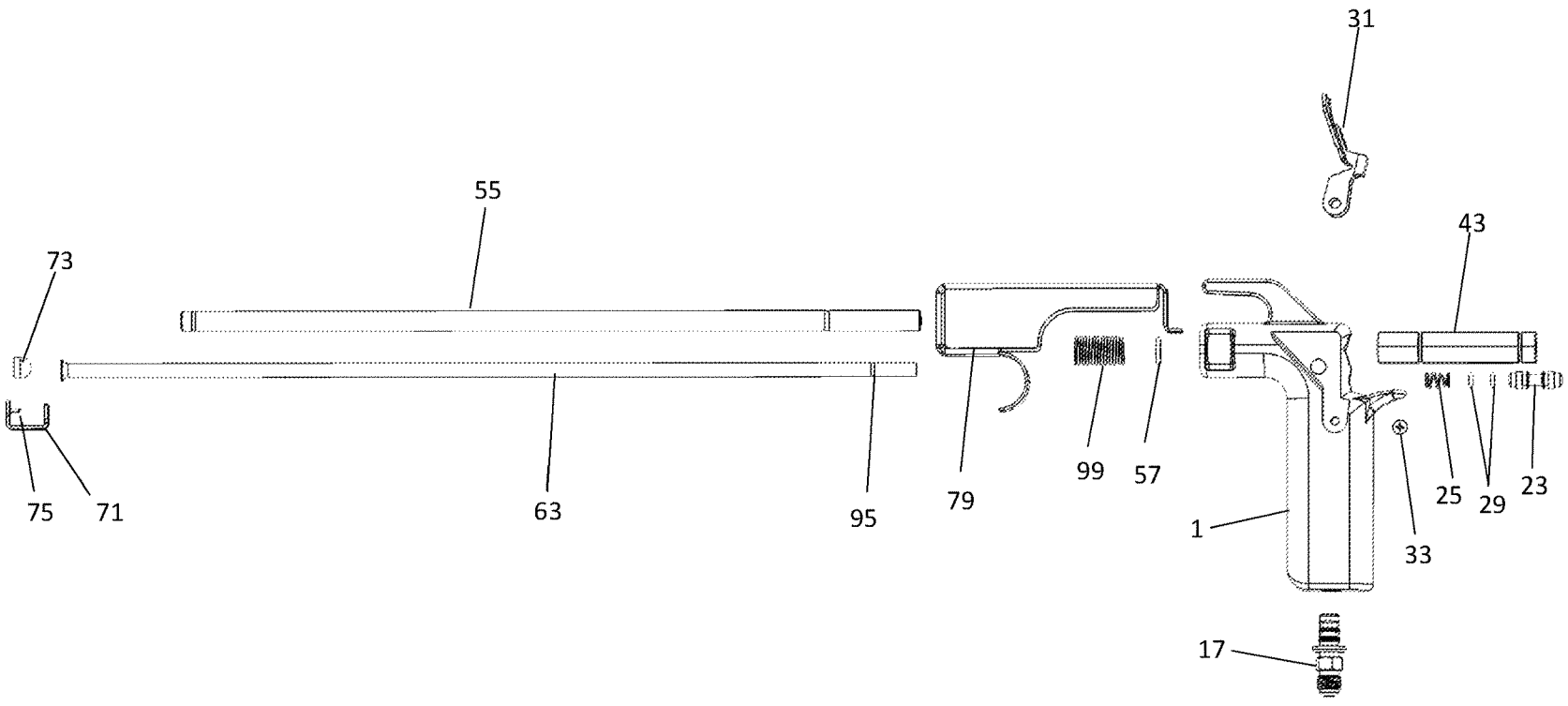
FIG. 3 is an exploded view of an exemplary embodiment of the present invention.

As shown in FIG. 3, the trigger mechanism can work in conjunction with a second biasing means 99 to maintain a seal between the sealing mechanism and the lower end of the inner tube. The biasing means 99 can be comprised of a spring located between the trigger mechanisms' lower end member 83 and the lower end 47 of the fitting 43. The length of the base member can be greater in length than the length of the spring.

Figure 5A:
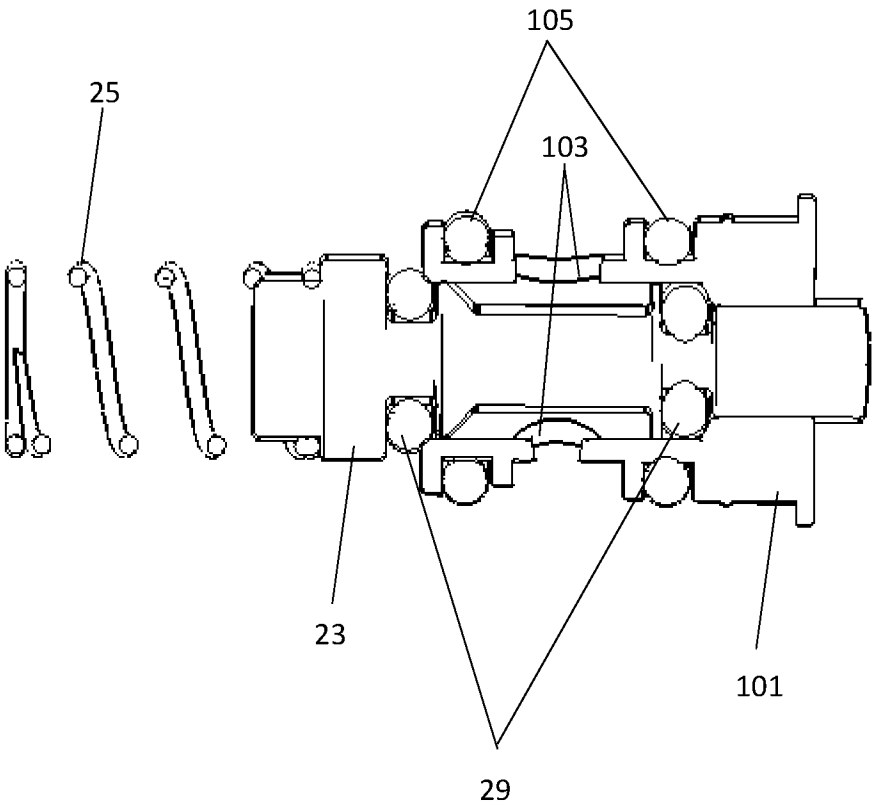
FIG. 5*a* is a cross-sectional view of an exemplary embodiment of a valve sleeve and components for the valve passageway.
Figure 5B:
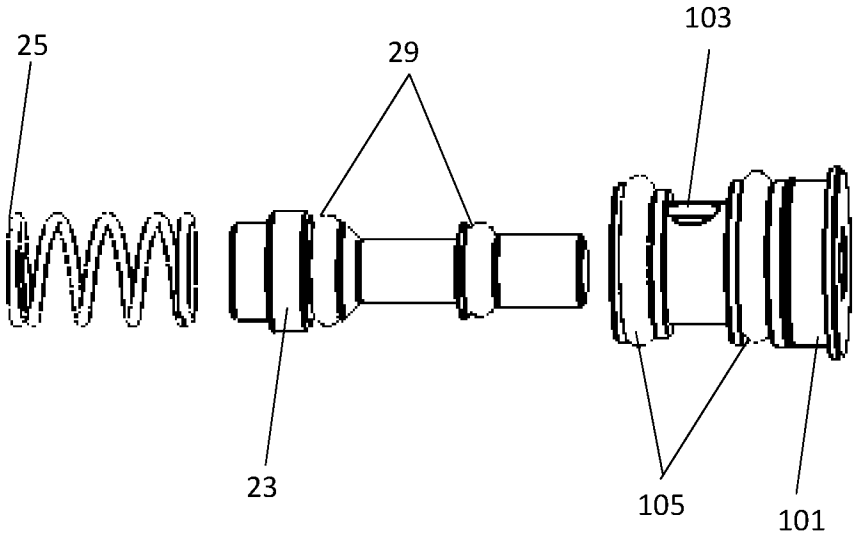
FIG. 5*b* is an exploded view of an exemplary embodiment of a valve sleeve and components for the valve passageway.

As shown in FIG. 5*a*-5*b*, in one exemplary embodiment of the present invention, the valve passage can further include a valve sleeve 101. The valve sleeve can include at least one o-ring 105 to help create a seal between the valve sleeve 101 and the valve passage. This can allow the valve sleeve 101 to be press fit into the valve passage of the molded body. The valve sleeve can also have corresponding apertures 103 that allow the grip passage to be fluidly connected to the housing passage. The valve sleeve can accommodate the valve actuator 23 and its o-rings 29 to form a sealed valve in the valve passage. When the valve actuator 23 and biasing means 25 are depressed it allows for a gas to flow through the valve apertures 103. A gas can then flow from the grip passage and into the housing passage. The valve sleeve can provide less friction resulting in less sticking of the valve actuator o-rings 29 against the valve passage and thus more effective operations of the valve actuator. Additionally, it minimizes the need for any lubrication of the valve to ensure proper operation. The valve sleeve 101 can be comprised of any suitable material, such as a polymer or metal. In one exemplary embodiment, the valve sleeve can be comprised of brass.

The present disclosure can also include other embodiments that would be apparent to those of ordinary skill in the art. In another exemplary embodiment of the present invention, the molded body can act as a housing for a valve and a fitting. A molded body can surround a valve body and elbow, which can provide a user with improved control and operation of the EBFA. The exterior of the fitting may be hexagonal in shape to insure little movement within the molded body. The molded body can also act as a structural support for affixing the valve body to the elbow fitting.

The present disclosure relates to a valve body having a lower end and an upper end with an externally threaded fitting attached to the lower end that can be used for attaching a quick disconnect fitting or other fittings suitable for attaching the EBFA to an external compressed gas source, such as carbon dioxide or nitrogen gas. The valve body can be made from any suitable non-corrosive or anti-corrosive material, such as brass, stainless steel, or polymer. A passage can extend between the upper end of the valve and the lower end of the valve. The passage is interrupted by a valve actuator that can either be placed in an open position or closed position to allow or restrict the flow of a compressed gas through the valve.

A biasing means for actuating the valve actuator may be located within the valve body. The valve actuator in its normal state has the passage between the two ends of the valve in a closed position. The biasing means can be comprised of a spring allowing a user to depress the valve actuator that then places the valve in the open position. The valve actuator may further include polymer o-rings that form a seal to prevent the flow of gas through the passage when the valve actuator is in the closed position. The valve actuator can be depressed using an ambidextrous or double sided trigger mechanism that can be attached to a molded body. The double trigger allows the EBFA to be used ambidextrously between the right and left hand. The double trigger can be affixed to a molded body using a fastener.

Further extending from the upper end of the valve body the EBFA can have a fitting physically or fluidly attached to the valve body. The fitting can be comprised of the same or similar material as the valve body. The fitting can be positioned perpendicular to the valve body and has a lower end and an upper end with a passage there through. A lower end of the passage can have a first pre-established diameter and an upper end of the fitting passage can have a second pre-established diameter. An aperture fluidly connecting the valve to the fitting can be located in the upper end of the fitting.

An outer tube can be located within the lower end of the fitting. The outer tube can have pre-established interior diameter and exterior diameter. The outer tube can have a lower end and an upper end, where the upper end can have a flared portion that can help seat the outer tube inside the fitting's lower end. The outer tube's lower end can extend past the fitting's lower end for a predetermined length. The outer tube can be made from any suitable material, such as a stainless steel, copper, or brass.

The exterior diameter of the outer tube is slightly smaller than the first pre-established diameter of the fitting's lower end. An o-ring can be located near the end of the upper end and lower end of the fitting to create an air tight seal between the fitting and the outer tube and inner tube respectively.

Located within the outer tube is an inner tube. The inner tube can have an interior diameter and an exterior diameter. The inner tube's exterior diameter is slightly smaller than the outer tube's interior diameter and the fitting's passage upper end. The inner tube's upper end can extend past the upper end of the outer tube and the fitting's upper end. The upper end of the fitting passage can have at least one seal element configured to form a seal between the outside of the inner tube and the upper end of the fitting passage. In one exemplary embodiment, the seal element can be a sliding seal that allows the inner tube to easily slide within the fitting while also providing a seal between the inner tube and the upper end of the fitting. The sliding seal is configured to limit the amount of gas that escapes from the fitting when the compressed gas function of the EBFA is in use. Other embodiments can use any suitable means to form a sealing relationship between the inner tube and the fitting passage, such as a press fit, o-ring or threading.

In yet another exemplary embodiment the inner tube may have an o-ring or seal element located on the exterior of the inner tube that is configured to form a seal between the inner tube and the upper part of the fitting passage from the outside when the trigger mechanism is not in operation and a user is actuating the valve using the purge feature of the EBFA. The o-ring or seal element could also be located on the trigger mechanism near its connection to the inner tube and configured to operate in the same manner as described above when the trigger mechanism is not in operation.

The inner tube's lower end can extend past the lower end of the fitting and the outer tube's lower end. The lower end of the inner tube can be flared to allow it to seat properly with a sealing mechanism. The upper end of the inner tube can be fluidly connected to an external container, for example a keg that is under pressure.

The sealing mechanism can be attached to the outer tube's lower end and may have a seal member that can be made out of a polymer such as silicone, rubber, or other material. The sealing mechanism can extend beyond the length of the inner tube. The seal member can be affixed to the sealing mechanism using a pin to ensure that the sealing member will not easily be removed or accidentally detach from the sealing mechanism while the EBFA is being operated. To help create an adequate liquid-tight seal between the seal member and the lower end of the inner tube, the seal member can be semi-spherical in shape.

The EBFA can have a dual operation. By depressing a double trigger, a compressed gas can flow through the grip passage into the fitting passage and through an annulus formed between the outer and inner tube. When pulling the trigger mechanism, the sealing mechanism is unsealed from the inner tube, allowing fluid to be pushed through the inner tube by the pressure that is being applied to the external container. When filling a bottle or other container, the user can first depress the double trigger allowing the compressed gas to push out the air from the container, and then quick pull the trigger mechanism to fill the bottle or container. Once the container is filled, the user can remove the EBFA. The head space left in the container from removing the EBFA can then be purged one more time by depressing the double trigger.

Additionally, the exemplary embodiment of the present invention shown in FIGS. 1-FIG. 5*a-b*, can be primarily press fit together and does not require the use of tools to disassemble the primary components allowing for more frequent and easier cleaning of the EBFA. The cleanliness of brewing equipment is crucial to prevent contamination of the beer that might cause a beer's flavor profile to change over time.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. An enhanced bottle filler assembly comprising:

a molded body having a grip portion, a protrusion portion, and a housing portion, wherein a grip passage interposes said grip portion and a housing passage interposes said housing portion;

a valve passage between the grip passage and the housing passage, wherein said valve passage has valve actuator interposing said grip passage configured to control the passage of a gas through the grip passage and valve passage;

a fitting configured to be integrated into said housing passage, wherein said fitting has a fitting passage fluidly connected to the grip passage;

an outer tube configured to be integrated into said fitting passage, wherein said outer tube has an upper end and a lower end;

an inner tube configured to fit inside said outer tube forming an annulus between said inner and outer tube, wherein said inner tube has an upper end and a lower end;

a sealing mechanism coupled to the lower end of said outer tube, extending past the lower end of the outer tube and extending past the lower end of the inner tube, configured to form a sealing relationship between said sealing mechanism and lower end of said inner tube; and a trigger mechanism coupled to the upper end of said inner tube, configured to be capable of unseating said sealing mechanism from the lower end of said inner tube, wherein said trigger mechanism comprises a lower end member, an upper end member, and a base member, where said base member has a channel, wherein said protrusion portion protrudes through the channel in the trigger mechanism, wherein said protrusion portion and channel are configured to prevent said trigger mechanism from rotating around said outer tube.

2. The enhanced bottle filler assembly of claim 1 wherein exterior of said fitting and said housing passage of said fitting housing are configured such that the housing passage will fittingly engage said fitting.

3. The enhanced bottle filler assembly of claim 2 wherein said fitting is hexagonal.

4. The enhanced bottle filler assembly of claim 2 wherein said fitting has a knurled surface.

5. The enhanced bottle filler assembly of claim 1 wherein a grip end of the molded body has a threaded opening configured to accept a threaded fitting.

6. The enhanced bottle filler assembly of claim 1 wherein the fitting and the valve are made from corrosion resistant material.

7. The enhanced bottle filler assembly of claim 1 wherein said valve passage further comprises a valve sleeve, wherein said valve sleeve has the valve actuator therethrough configured to control the passage of a gas through the grip passage and valve passage.

8. The enhanced bottle filler assembly of claim 1 wherein said molded body is made from a polymer.

9. The enhanced bottle filler assembly of claim 1 wherein said molded body includes a protrusion on a dorsal side relative to the trigger portion configured to prevent slippage.

10. The enhanced bottle filler assembly of claim 1 wherein said molded body further surrounds a portion of said outer tube and a portion of said inner tube.

11. The enhanced bottle filler assembly of claim 1 wherein said molded body has a plurality of ribs extending along the longitudinal axis of the outer surface of the grip portion configured to prevent slippage.

12. The enhanced bottle filler assembly of claim 1, further comprises an ambidextrous trigger mechanism configured to depress said valve actuator to place the valve passage in an open position allowing the gas to pass through the valve passage and into the fitting passage and annulus.

13. An enhanced bottle filler assembly comprising:

a molded body having a grip portion and a housing portion, the housing portion and grip portions each having upper and lower ends, a grip passage interposing the grip portion, a valve actuator interposing the grip passage, the valve actuator being movable between open position allowing a flow in the grip passage between the upper and lower end of the grip portion and a closed position preventing a flow in the grip passage between the upper and lower end of the grip portion, a housing passage interposing upper and lower end of the housing, wherein said housing passage is fluidly connected to said grip passage;

a fitting having a upper end and a lower end, wherein said fitting is configured to be integrated into said housing passage and the upper end of the fitting has an aperture configured to be fluidly connected to upper end of the grip passage;

an outer tube having a predetermined interior diameter formed about an axis and an exterior diameter, an upper end and a lower end, the upper end of the outer tube being connected to the lower end of the fitting, the axis of the interior diameter coinciding with the axis of the bore in the fitting;

an inner tube having a pre-established exterior diameter and an interior diameter, an upper end and a lower end, the inner tube being partially positioned within the pre-established interior diameter of the outer tube, being partially positioned within the passage within the fitting and being partially positioned within the bore in the fitting, the inner tube being sealingly positioned in the bore of the fitting, the lower end of the inner tube extending beyond the lower end of the outer tube and the upper end of the inner tube extending beyond the upper end of the fitting and the upper end of the outer tube;

a trigger mechanism having a upper end and a lower end, the upper end of the trigger mechanism being attached to the upper end of the inner tube, and the lower end of the trigger mechanism having a trigger portion;

a sealing mechanism attached to the lower end of the outer tube and having a sealing member, the sealing member configured to be in a sealing relationship with the inner tube, wherein the sealing mechanism is affixed to the sealing member by a pin configured to prevent the sealing mechanism from detaching from the sealing member;

a biasing means for sealingly maintaining the sealing member in sealing relationship with the inner tube and the trigger mechanism being capable of unseating the sealing relationship of the sealing member and the inner tube; and an ambidextrous trigger mechanism configured to depress said valve actuator to place the valve passage in the open position allowing a gas to pass through the valve passage and into the fitting passage.

14. The enhanced bottle filler assembly of claim 13 wherein exterior of said fitting and said housing passage of said fitting housing are configured such that the housing passage will fittingly engage said fitting.

15. The enhanced bottle filler assembly of claim 13 wherein said molded body further comprises an extended hook portion, wherein the hook portion protrudes through the channel in trigger mechanism, wherein said hook portion and channel are configured to prevent said trigger mechanism from rotating around said outer tube.

16. The enhanced bottle filler assembly of claim 13 wherein said molded body includes protrusion on a dorsal side relative to the trigger portion configured to prevent slippage.

17. The enhanced bottle filler assembly of claim 13 wherein said molded body further surrounds a portion of said outer tube and a portion of said inner tube.

18. An enhanced bottle filler assembly comprising:

a valve having a upper end and a lower end, a passage interposing the upper end of the valve and the lower end of the valve, and a valve actuator interposing the passage, the valve actuator being movable between an open position allowing a flow in the passage between the upper end of the valve and the lower end of the valve and a closed position preventing a flow in the passage between the first end of the valve and the lower end of the valve;

a fitting defining a body, having an upper end and a lower end, the upper end of the fitting being connected to the lower end of the valve, a passage interposing the upper and lower end of the fitting, an axis being perpendicular to the lower end of the valve and extending along at least a portion of the passage, a bore having a pre-established diameter being positioned in the body, along the axis and extending externally of the body and into the passage within the fitting;

an outer tube having a pre-established interior diameter formed about an axis and an exterior diameter, a upper end and a lower end, the upper end of the outer tube being connected to the lower end of the fitting, the axis of the interior diameter coinciding with the axis of the bore in the fitting;

an inner tube having a pre-established exterior diameter and an interior diameter, a upper end and a lower end, the inner tube being partially positioned within the pre-established interior diameter of the outer tube, being partially positioned within the passage within the fitting and being partially positioned within the bore in the fitting, the inner tube being sealingly positioned in the bore in the fitting, the lower end of the inner tube extends beyond the lower end of the outer tube and the upper end of the inner tube extends beyond the body of the fitting;

a molded body surrounding said valve and fitting, wherein the molded body is configured to protect a user from compressed gas leaks and extreme temperature variations from the valve or fitting;

a trigger mechanism having an upper end and a lower end, the upper end of the trigger mechanism being attached to the inner tube near the upper end of the inner tube and the lower end of the trigger mechanism have a trigger portion;

a sealing mechanism has an attaching end being attached near the lower end of the outer tube and a sealing member extending beyond the lower end of the outer tube, the sealing member being precisely located to be capable of being in sealing relationship with the inner tube, wherein the sealing mechanism is affixed to the sealing member by a pin configured to prevent the sealing mechanism from detaching from the sealing member; and a biasing means for sealingly maintaining the sealing member in sealing relationship with the inner tube and the trigger mechanism being capable of unseating the sealing relationship of the sealing member and the inner tube.

* * * * *